US008997269B1

(12) United States Patent
Jackson et al.

(10) Patent No.: US 8,997,269 B1
(45) Date of Patent: Apr. 7, 2015

(54) SWIMMING POOL HOSE HOLDER

(76) Inventors: Ray A. Jackson, Surprise, AZ (US); Debra L. Bindel, Surprise, AZ (US)

( * ) Notice: Subject to any disclaimer, the term of this patent is extended or adjusted under 35 U.S.C. 154(b) by 679 days.

(21) Appl. No.: 13/400,641

(22) Filed: Feb. 21, 2012

(51) Int. Cl.
*E04H 4/00* (2006.01)
*E04H 4/16* (2006.01)

(52) U.S. Cl.
CPC . *E04H 4/169* (2013.01); *E04H 4/16* (2013.01)

(58) Field of Classification Search
CPC ..... E04H 4/169; E04H 4/14; E04H 4/16
USPC ..... 4/490, 496; 248/75, 82, 84, 86
See application file for complete search history.

(56) References Cited

U.S. PATENT DOCUMENTS

| | | | | |
|---|---|---|---|---|
| 1,855,630 | A * | 4/1932 | Hempel | 248/81 |
| 2,537,703 | A * | 1/1951 | Randa | 248/75 |
| 3,220,680 | A | 11/1965 | Williams | |
| 4,228,553 | A | 10/1980 | Genuit | |
| 5,110,075 | A | 5/1992 | Reid et al. | |
| 5,275,721 | A | 1/1994 | Mathews | |
| 5,765,699 | A | 6/1998 | Griffin | |
| 6,186,449 | B1 * | 2/2001 | Chrestenson | 248/49 |
| 7,334,601 | B1 | 2/2008 | Torkelson | |
| 2007/0210215 | A1 * | 9/2007 | Prest | 248/80 |

* cited by examiner

*Primary Examiner* — Huyen Le
(74) *Attorney, Agent, or Firm* — Robert C. Montgomery; Montgomery Patent & Design

(57) ABSTRACT

The present invention is a swimming pool hose holder used to retain a sweeper hose along a side wall of a swimming pool when the sweeper hose is not in use. The swimming pool hose holder includes a mounting plate that is attached to a securing plate using a spring-biased hinge. In use the swimming pool hose holder is located such that a retained sweeper hose is half above the waterline and half below the waterline. Either a fastening surface on the mounting plate is used to attach the swimming pool hose holder to a pool side wall or the mounting plate includes openings for fasteners to be used to attach the swimming pool hose holder to a pool side wall. In operation the sweeper hose is retained between the plates when the sweeper hose is not being used.

20 Claims, 4 Drawing Sheets

SWIMMING POOL HOSE HOLDER

RELATED APPLICATIONS

There are currently no applications co-pending with the present application.

FIELD OF THE INVENTION

The presently disclosed subject matter is directed towards swimming pool attachments. More specifically, the present invention relates to attachments for retaining swimming pool sweeper hoses against the side of the pool.

BACKGROUND OF THE INVENTION

Few leisure time activities rival spending a hot summer day in a swimming pool. Whether it is a large, in-ground, Olympic size pool, or a smaller backyard above-ground pool, the relaxation, comfort, and enjoyment derived from a swimming pool is a benefit to all lucky enough to experience it.

While enjoyable, owning a swimming pool brings with it a certain set of responsibilities. One (1) of those responsibilities relates to the often time consuming and cumbersome task of cleaning the pool of leaves, insects, debris, algae and other contaminates. Many pool owners turn to the use of automatic pool cleaners to clean the bottom and sides of the pool. Typically such automatic pool cleaners are comprised of a pool filter pump that is tethered to a pool sweeper hose that sucks debris and contaminates into the filter. While such devices can work very well the sweeper hose does tend to get in the way when the pool is being used.

Some users simply remove the pool filter pump and sweeper hose from the pool and set it nearby. While this prevents the automatic pool cleaner from getting in the way of swimmers it does present several problems. First, exterior storage locations expose the pool filter pump and sweeper hose to dirt, grass clippings and other contaminants which can end up back in the pool when the pool filter pump and sweeper hose are used next. Second, removing a sweeper hose usually empties it of water. This forces the user to spend valuable time and effort refilling and "priming" the sweeper hose the next time it is used. Finally, and perhaps most importantly, many users simply forget to replace the automatic pool cleaner back in the pool.

Accordingly, there exists a need for a device which enables the benefits of automatic pool cleaners without the disadvantages described above. Beneficially that device would take the form of a swimming pool hose holder that retains the sweeper hose of an automatic pool cleaner to the side of a pool. Preferably such a swimming pool hose holder would allow pool owners to utilize automatic pool cleaners to keep their pools clean without the aggravation associated with constantly tending and avoiding the sweeper hose. Preferably such devices would be configured to easily or automatically free the sweeper hose when it is needed.

SUMMARY OF THE INVENTION

The principles of the present invention provide for swimming pool hose holders that retain the sweeper hoses of automatic pool cleaners to the sides of swimming pools when the automatic pool cleaners are not being used. Preferably such swimming pool hose holders readily or automatically free the sweeper hose when it is needed.

A swimming pool hose holder according to one aspect of the present invention retains a sweeper hose against the side wall of a swimming pool using a mounting plate having a backside fastening adhesive surface. A securing plate pivotally connects to the mounting plate using a spring-biased hinge. The mounting plate and the securing plate are dimensioned to retain the sweeper hose between them. According to another aspect of the present invention a swimming pool hose holder retains a sweeper hose against the side wall of a swimming pool using a mounting plate having a plurality of fastener apertures that enable mechanical fasteners to secure the swimming pool hose holder along a side wall. Again, a securing plate pivotally connects to the mounting plate using a spring-biased hinge, and the mounting plate and the securing plate are dimensioned to retain the sweeper hose between them.

The swimming pool hose holder hinge biases the securing plate flush against the mounting plate when the swimming pool holder is not being used. Beneficially the hinge produces a bias force powerful enough to retain the sweeper hose between the mounting plate and the securing plate. Generally, the securing plate and the mounting plate will be rectangular. The securing plate should extend past the mounting plate.

According to another aspect of the present invention a swimming pool with a water reservoir having a bottom and a side wall and an automatic swimming pool cleaner with a sweeper hose disposed in the swimming pool includes at least one swimming pool hose holder. The swimming pool hose holder is attached to the side wall. The swimming pool hose holder includes a mounting plate that is fastened to the side wall and a securing plate that is pivotally attached to the mounting plate by a spring-biased hinge. The hinge is disposed toward the bottom, and the swimming pool hose holder is dimensioned and configured to retain the sweeper hose between the mounting plate and the securing plate.

The swimming pool can have the mounting plate fastened to the side wall by an adhesive or by using mechanical fasteners. Beneficially the securing plate extends past a top of the mounting plate, the hinge is below the water line, and the top of the mounting plate is above the water line. The securing plate and the mounting plate should be dimensioned to retain the sweeper hose between them. The hinge should provide sufficient bias to force the securing plate flush against the mounting plate when the sweeper hose is not retained between them and sufficient force to retain the sweeper hose between the mounting plate and the securing plate.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
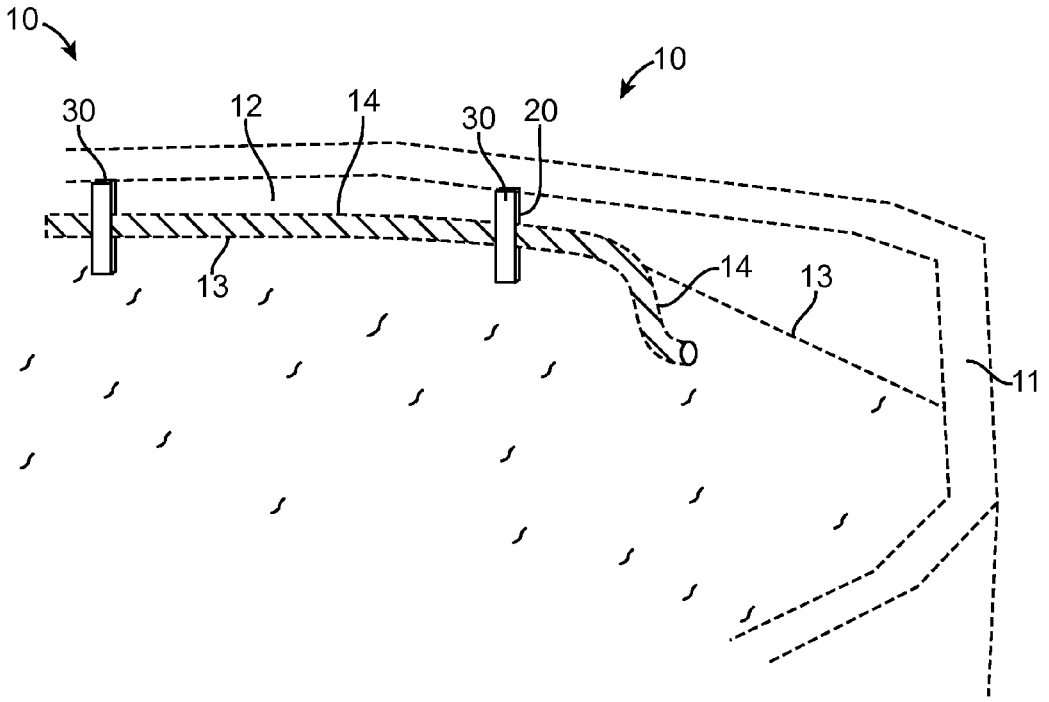
FIG. 1 is an environmental view of two swimming pool hose holders 10 that are in accord with the principles of the present invention and that are in service retaining a sweeper hose 14 in position along the side wall 12 of a swimming pool 11.

10 swimming pool hose holder
11 swimming pool
12 side wall
13 water line
14 sweeper hose
20 mounting plate
25 fastening surface
30 securing plate
35 hinge
36 fasteners
40 alternate mounting plate
41 mounting fastener
42 alternative swimming pool hose holder

DETAILED DESCRIPTION OF THE PREFERRED EMBODIMENT

Figure 2:
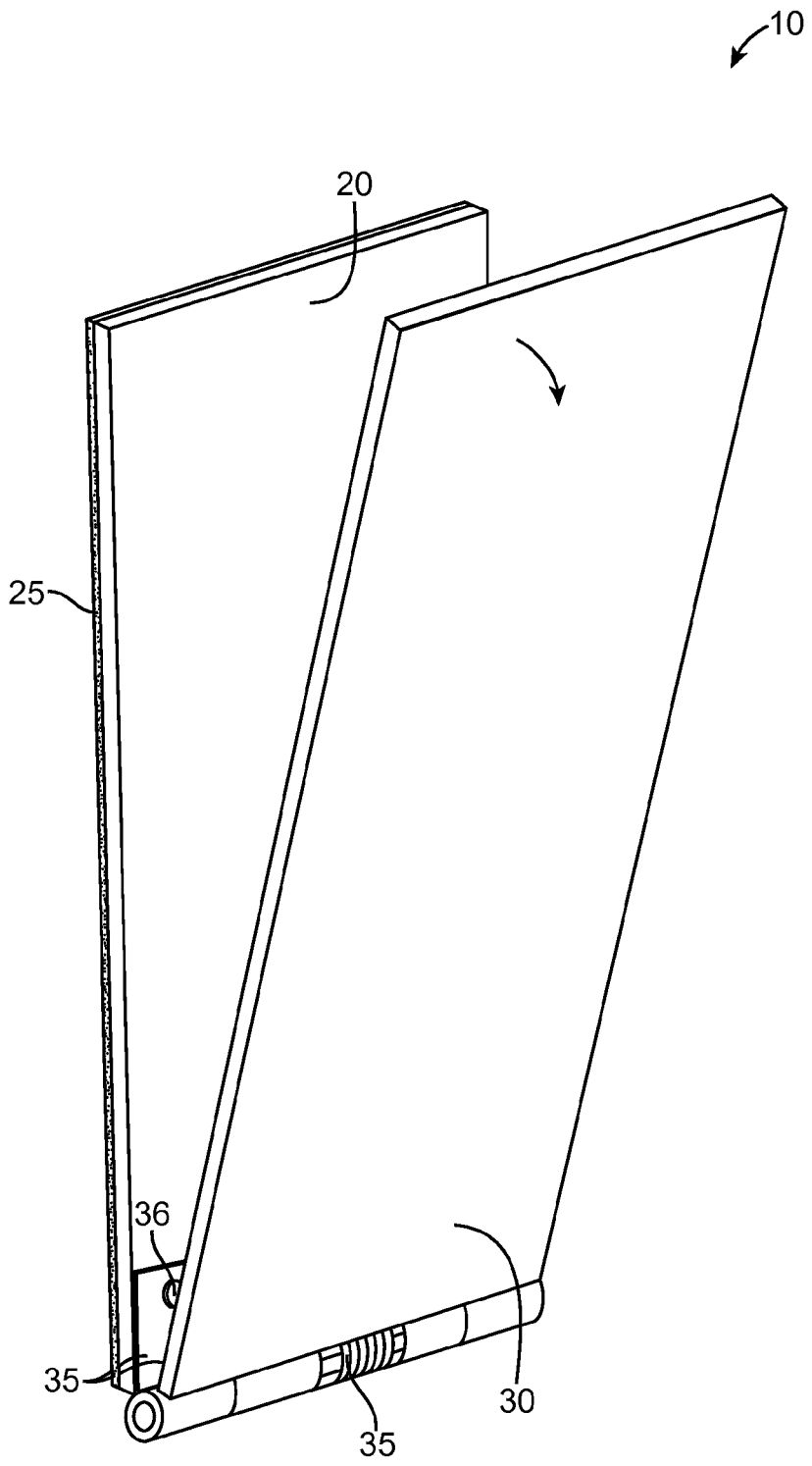
FIG. 2 is a perspective view of a swimming pool hose holder 10 depicted in FIG. 1.
Figure 3:
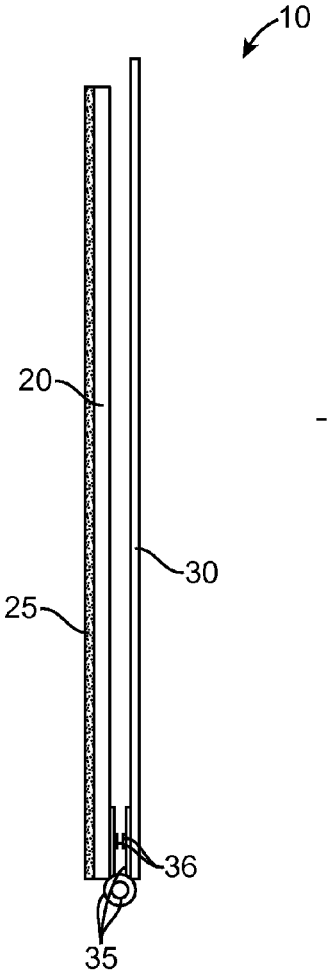
FIG. 3 is a side view of the swimming pool hose holder 10 depicted in FIGS. 1 and 2 when the swimming pool hose holder 10 is closed.

The best mode for carrying out the invention is presented in terms of its preferred embodiment, herein depicted within FIGS. 1 through 4, and alternately within FIG. 3. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The principles of the present invention are illustrated with reference to FIGS. 1-5. Those principles relate to illustrated swimming pool hose holders 10 and 42 that retain a sweeper hose 14 against the side wall 12 of a swimming pool 11. The swimming pool hose holders 10 and 42 beneficially enable swimmers to swim freely without having the sweeper hose 14 become a nuisance or a hazard while also avoiding problems often encountered when the sweeper hose 14 is removed from the swimming pool 11.

FIG. 1 illustrates an environment in which a swimming pool hose holder 10 and an alternative swimming pool hose holder 42 are used. Those swimming pool hose holders 10 and 42 are mounted upon the side wall 12 of a swimming pool 11, beneficially such that the swimming pool hose holders 10 and 42 are half way above and half way below a waterline 13. As described below the swimming pool hose holders 10 and 42 are implemented such that they retain the sweeper hose 14 along the side wall 12.

Figure 4:
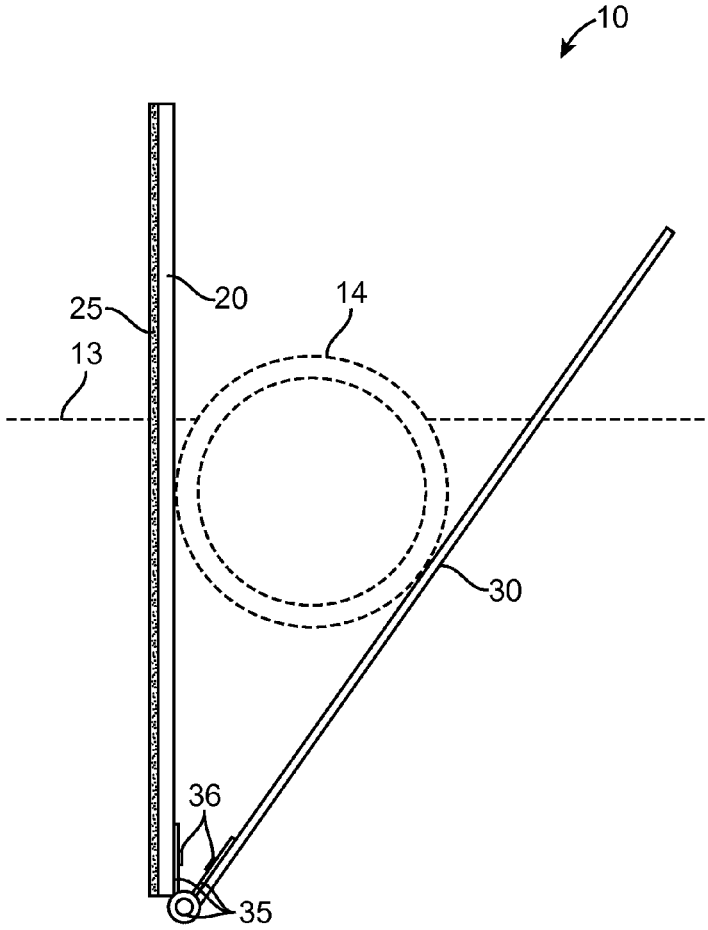
FIG. 4 is side view of the swimming pool hose holder 10 depicted in FIGS. 1-3 when the swimming pool hose holder 10 is retaining a sweeper hose 14; and, FIG. 5 is a perspective view of a swimming pool hose holder 42 that uses an alternate mounting plate 40 and which is in accord with the principles of the present invention.
Figure 5:
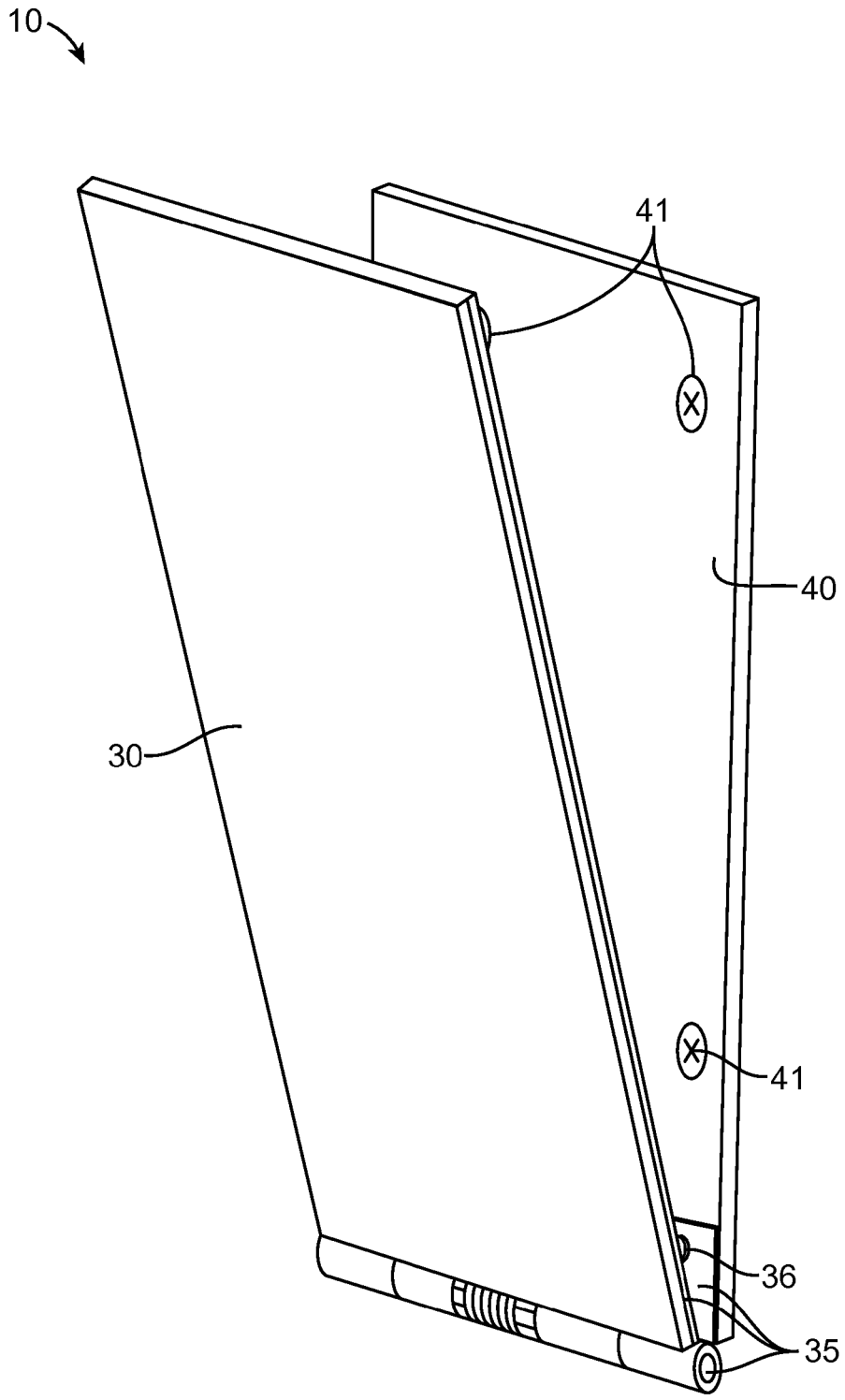

Still referring to FIG. 1, the swimming pool 11 might be an above-ground, an in-ground, a temporary, and/or a seasonal swimming pool. However, the swimming pool 11 is of the type that uses an automatic pool sweeper that includes the sweeper hose 14. Preferably at least a pair of swimming pool hose holders 10, 42 are used, with additional swimming pool hose holders 10, 42 being added as required to retain the length of sweeper hose 14 against the side wall 12. The swimming pool hose holder 10, which is described in more detail below with reference to FIGS. 2-4, is particularly suitable for use with an existing swimming pool 11, while the alternative swimming pool holder 42, which is shown in FIG. 5, is particularly suitable for use with a newly manufactured or constructed swimming pool 11.

FIG. 2 presents a perspective view of the swimming pool hose holder 10. The swimming pool hose holder 10 includes a mounting plate 20 for attaching the swimming pool hose holder 10 to the side wall 12 of a swimming pool 11 and a securing plate 30 that is coupled to the mounting plate 20 by a spring-biased hinge 35 using fasteners 36. The plates 20, 30 are rectangular and provide a low-profile design that maintains the swimming pool hose holder 10 in flush orientation against the side wall 12 when a sweeper hose 14 is not being held. This flush orientation reduces the likelihood of accidental injury to swimmers. The plates 20, 30 are fabricated from a rustproof metal, plastic, or the like and are dimensioned to retain a sweeper hose 14 as shown in FIG. 4. Ideally the swimming pool hose holder 10 is positioned in the swimming pool 11 such that the plates 20, 30 retain the sweeper hose 14 in its natural buoyant position relative to the waterline 13.

The back of the mounting plate 20 has a fastening surface 25 that enables the swimming pool hose holder 10 to be secured to the side wall 12. The fastening surface 25 is preferably formed by a commercially available marine grade adhesive. The securing plate 30 is slightly longer than the mounting plate 20 (see FIG. 3). This enables a user to easily grasp and open the securing plate 30 (see FIG. 4). When open, the securing plate 30 is pivoted away from the mounting plate 20 to enable a section of a sweeper hose 14 to be positioned between the plates 20, 30.

Referring again to FIG. 2, as abovementioned the securing plate 30 is attached to the mounting plate 20 by a spring hinge 35. The hinge 35 biases the securing plate 30 toward the mounting plate 20. This creates a force that secures the sweeper hose 14 between the mounting plate 20 and the securing plate 30. The hinge 35 is attached along a proximal perimeter edge of the plates 20, 30 using any of a variety of common fasteners, welds, glues, or the like. The force exerted from the hinge 35 is beneficially i.) powerful enough to retain the sweeper hose 14 against the side wall 12 when the swimming pool 11 is being used, and ii.) unsubstantial enough to enable a user to easily remove the sweeper hose 14 from between the plates 20, 30. Preferably, the force exerted from the hinge 35 can be overcome by forces induced on the sweeper hose 14 by the automatic pool cleaner such that the sweeper hose 14 automatically removes itself from the swimming pool hose holder 10 (or the alternative swimming pool hose holder 42). Minor experimentation may be required to achieve the required balance given the particular sweeper hose 14, hinge 35, number of swimming pool hose holders 10 being used, the dimensions of the mounting plate 20 and securing plate 30, the forces induced by the automatic pool cleaner, and other factors. However, such experimentation can be easily accomplished by those skilled in the applicable arts.

FIG. 3 is a side view of the swimming pool hose holder 10 illustrated in FIG. 2 when the swimming pool hose holder 10 is closed, while FIG. 4 is a side view of the swimming pool hose holder 10 when opened and retaining a sweeper hose 14 between the mounting plate 20 and the securing plate 30. As noted the swimming pool hose holder 10 is mounted on the side wall 12 (see FIG. 1), such that the hinge 35 is disposed toward the bottom of the swimming pool 11.

As shown in FIG. 3 when the swimming pool hose holder 10 is closed it has a flush profile against the side wall 12 and the slightly longer securing plate 30 can easily be grasped. FIG. 3 shows the fastening surface 25 in more detail. Additionally, it should be noted that while FIG. 4 shows the sweeper hose 14 arranged horizontally between the plates 20, 30, in some applications it might be better to arrange the sweeper hose 14 in a looped orientation, possibly a "figure-8".

Refer now to FIG. 5 for a perspective view of the alternative swimming pool hose holder 42. Instead of the mounting plate 20 and a fastening surface 25 the swimming pool hose holder 42 incorporates a mounting plate 40. The mounting plate 40 enables the swimming pool hose holder 42 to be attached to a side wall 12 of the swimming pool 11 using a plurality of mounting fasteners 41 that pass through the mounting plate 40. As noted the alternative swimming pool hose holder 42 is particularly useful as when incorporated as original equipment in a new swimming pool 11. The mechanical fasteners 41 are beneficially common fasteners such as screws while the alternate mounting plate 40 is fabricated from similar materials as the preferred mounting plate 20.

In any event, the present invention can be utilized by the common user in a simple and effortless manner with little or no training. After initial purchase or acquisition of a swimming pool hose holder 10 or an alternative swimming pool hose holder 42 the swimming pool hose holder 10, 42 would be installed as indicated in FIG. 1. The method of installing and utilizing the swimming pool hose holder 10 may be achieved by performing the following steps: acquiring the swimming pool hose holder 10; placing the fastening surface 25 against the side wall 12 of a swimming pool 11 with the hinge 35 positioned toward the bottom of the swimming pool 11 and the plates 20, 30 half way above and half way below the waterline 13; pulling the securing plate 30 away from the mounting plate 20 and placing a portion of the sweeper hose 14 between the plates 20, 30; releasing the securing plate 30 against the sweeper hose 14 and enabling the swimming pool hose holder 10 to retain the portion of the sweeper hose 14; repeating the above steps as desired for the use of multiple swimming pool hose holders 10; removing the sweeper hose 14 from the swimming pool hose holder 10 or releasing the sweeper hose 14 from the plates 20, 30 as desired; and, enabling the swimming pool hose holder 10 to retain a sweeper hose 14 in a nuisance free manner as desired.

The method of installing and utilizing the alternative swimming pool hose holder 42 may be achieved by performing the following steps as indicated in FIG. 5: acquiring the alternative swimming pool hose holder 42; placing the mounting plate 40 against the side wall 12 of a swimming pool 11 with the hinge 35 positioned toward the bottom of the swimming pool 11 and the plates 20, 30 half way above and half way below where the waterline 13 should be, attaching the alternative swimming pool hose holder 42 to the side wall 12 using mounting fasteners 41; pulling the securing plate 30 away from the alternative swimming pool hose holder 42 and placing a portion of the sweeper hose 14 between said plates 30, 40; releasing the securing plate 30 against the sweeper hose 14 and enabling the alternative swimming pool hose holder 42 to retain the sweeper hose 14; repeating the above steps as desired for the use of multiple alternative swimming pool hose holders 42; removing the sweeper hose 14 from the alternative swimming pool hose holder 42 or enabling the existing automatic sweeper to release the sweeper hose 14 from the plates 30, 40 as desired; and, enabling the alternative swimming pool hose holder 42 to retain a sweeper hose 14 in a nuisance free manner as desired.

The materials required to produce the alternative swimming pool hose holder 10 and the alternative swimming pool hose holder 42 are all readily available and well known to manufacturers of goods of this type. The majority of the swimming pool hose holders 10, 42 would be made of heavy duty impact resistant plastic in an injection molding process. Plastics that are resistant to water, pool chemicals, UV radiation, and the like would be required. Other components of the invention such as stainless steel plates, springs, hinges, fasteners, and the like would best be procured from wholesalers and manufacturers that deal in goods of that nature and assembled at a final location. The relatively simple design of the invention and the material of construction make the alternative swimming pool hose holder 10, 42 a cost-effective design due to the relatively low material and labor costs involved.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A swimming pool hose holder for retaining a sweeper hose, comprising:

a mounting plate having a backside fastening surface that enables said swimming pool hose holder to be secured to a side wall of a swimming pool;

a securing plate; and, a spring-biased hinge pivotally connecting said securing plate to said mounting plate;

wherein said mounting plate and said securing plate are dimensioned to retain a sweeper hose therebetween.

2. The swimming pool hose holder according to claim 1 wherein said hinge biases said securing plate flush against said mounting plate when said swimming pool holder is not being used.

3. The swimming pool hose holder according to claim 2 wherein said hinge produces a bias force powerful enough to retain a sweeper hose disposed between said mounting plate and said securing plate.

4. The swimming pool hose holder according to claim 1 wherein said securing plate and said mounting plate are rectangular.

5. The swimming pool hose holder according to claim 4 wherein said securing plate extends past said mounting plate.

6. The swimming pool hose holder according to claim 1 wherein said securing plate, said mounting plate, and said hinge are configured to retain a sweeper hose between them.

7. A swimming pool hose holder for retaining a sweeper hose, comprising:

a mounting plate having a plurality of fastener apertures to enable said swimming pool hose holder to be secured to a side wall of a swimming pool;

a securing plate; and, a spring-biased hinge pivotally connecting said securing plate to said mounting plate;

wherein said mounting plate and said securing plate are dimensioned to retain a sweeper hose therebetween.

8. The swimming pool hose holder according to claim 7 wherein said hinge biases said securing plate flush against said mounting plate when said swimming pool holder is not being used.

9. The swimming pool hose holder according to claim 8 wherein said hinge produces a bias force powerful enough to retain a sweeper hose disposed between said mounting plate and said securing plate.

10. The swimming pool hose holder according to claim 7 wherein said securing plate and said mounting plate are rectangular.

11. The swimming pool hose holder according to claim 10 wherein said securing plate extends past said mounting plate.

12. The swimming pool hose holder according to claim 7 wherein said securing plate, said mounting plate, and said hinge are configured to retain a sweeper hose between them.

13. A swimming pool comprising:

a water reservoir having a bottom and a side wall;

water in said water reservoir such that said water forms a water line on said side wall;

an automatic swimming pool cleaner having a sweeper hose disposed in said swimming pool; and, a swimming pool hose holder comprised of a mounting plate fastened to said side wall and a securing plate pivotally attached to said mounting plate by a spring-biased hinge;

wherein said hinge is disposed toward said bottom; and, wherein said swimming pool hose holder is dimensioned and configured to retain said sweeper hose between said mounting plate and said securing plate.

14. The swimming pool according to claim 13 wherein said mounting plate is fastened to said side wall by an adhesive.

15. The swimming pool according to claim 13 wherein said mounting plate is fastened to said side wall by at least one mechanical fastener.

16. The swimming pool according to claim 13 wherein said securing plate extends past a top of said mounting plate.

17. The swimming pool according to claim 16 wherein said swimming pool hose holder is fastened to said side wall such that said hinge is below said water line and said top of said mounting plate is above said water line.

18. The swimming pool according to claim 13 wherein said securing plate and said mounting plate are dimensioned to retain said sweeper hose between them.

19. The swimming pool according to claim 18 wherein said hinge biases said securing plate flush against said mounting plate when said sweeper hose is not retained between them.

20. The swimming pool according to claim 13 wherein said hinge produces a bias force powerful enough to retain said sweeper hose between said mounting plate and said securing plate.

* * * * *